US011124360B2

(12) United States Patent
McNeilus et al.

(10) Patent No.: US 11,124,360 B2
(45) Date of Patent: Sep. 21, 2021

(54) REFUSE COLLECTION VEHICLE WITH IMPROVED SERVICEABILITY

(71) Applicant: Con-Tech Manufacturing, Inc., Dodge Center, MN (US)

(72) Inventors: Garwin McNeilus, Dodge Center, MN (US); Grant McNeilus, Dodge Center, MN (US); Brian Meldahl, Brownsdale, MN (US); Jay Attleson, Rochester, MN (US); Ryan Smith, Dodge Center, MN (US)

(73) Assignee: Con-Tech Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 16/438,418

(22) Filed: Jun. 11, 2019

(65) Prior Publication Data

US 2019/0375586 A1 Dec. 12, 2019

Related U.S. Application Data

(60) Provisional application No. 62/683,606, filed on Jun. 11, 2018.

(51) Int. Cl.

| | |
|---|---|
| ***B65F 3/10*** | (2006.01) |
| ***B65F 3/28*** | (2006.01) |
| ***B65F 3/08*** | (2006.01) |
| *B65F 1/14* | (2006.01) |
| *B65F 3/00* | (2006.01) |
| *B65F 3/02* | (2006.01) |

(52) U.S. Cl.

CPC ..... *B65F 3/10* (2013.01); *B65F 3/28* (2013.01); *B65F 1/1426* (2013.01); *B65F 3/08* (2013.01); *B65F 2003/006* (2013.01); *B65F 2003/0283* (2013.01)

(58) Field of Classification Search

CPC ..... B65F 3/08; B65F 3/10; B65F 3/28; B65F 2003/006; B65F 2003/0283; B60R 9/00; B60R 11/06

USPC ..... 296/37.6

See application file for complete search history.

(56) References Cited

U.S. PATENT DOCUMENTS

| | | | | |
|---|---|---|---|---|
| 4,096,959 A * | 6/1978 | Schaffler | B65F 3/143 414/408 |
| 4,892,454 A * | 1/1990 | Behling | B65F 3/207 414/406 |
| 5,772,271 A * | 6/1998 | Sanders | B60P 3/42 296/183.1 |
| 5,782,596 A * | 7/1998 | Young | B60P 3/125 280/402 |
| 6,719,226 B2 * | 4/2004 | Rajewski | B02C 13/04 241/101.741 |

(Continued)

*Primary Examiner* — James Keenan

(74) *Attorney, Agent, or Firm* — Craig J. Lervick; Larkin Hoffman Daly & Lindgren Ltd.

(57) ABSTRACT

A collection body is designed and coordinated so that equipment and frequently serviced components can be easily accessed by any operator while also staying away from lanes of traffic. The collection body is further designed so the main hopper is substantially rectangular, so that sidewalls are continuous and support operation of ejection pushers and related component. This configuration is also coordinated with the collection hopper and other collection mechanisms, so that overall coordination of all components is efficient and effective.

16 Claims, 7 Drawing Sheets

(56) References Cited

U.S. PATENT DOCUMENTS

| | | | | |
|---|---|---|---|---|
| 6,722,839 | B2 * | 4/2004 | Bingman | B65F 3/00 414/409 |
| 7,070,382 | B2 * | 7/2006 | Pruteanu | B65F 3/201 414/525.2 |
| 7,198,213 | B2 * | 4/2007 | Kolbet | B02C 18/0007 241/101.74 |
| 8,360,706 | B2 * | 1/2013 | Addleman | B60P 3/12 414/470 |
| 8,739,892 | B2 * | 6/2014 | Moore | B60K 11/04 169/24 |
| 10,196,205 | B2 * | 2/2019 | Betz, II | B65F 3/208 |
| 10,859,167 | B2 * | 12/2020 | Jax | F01L 1/26 |

* cited by examiner

REFUSE COLLECTION VEHICLE WITH IMPROVED SERVICEABILITY

BACKGROUND

Refuse collection vehicles or garbage trucks have been in existence for quite some time, and provide an invaluable service for society. Generally speaking, these vehicles are configured and designed to allow the collection of garbage in various receptacles which are maintained by homes and businesses. In more recent years, these vehicles have been configured and designed to allow for the automated collection of garbage, without requiring an operator or an attendant to get out of the vehicle cab. As is prominent in the residential garbage collection business, these vehicles typically have pickup mechanisms mounted to the curb side of the vehicle, thus allowing an operator to simply drive the vehicle to an appropriate position adjacent a refuse container, and coordinate collection utilizing only automated equipment. As is recognized, this automated equipment will capture the refuse container, and cause it to be emptied into a collection hopper. This collection hopper is typically located at an upper part of the vehicle. One example of these mechanisms can be found in co-pending U.S. patent application Ser. No. 15/189,150 entitled "Automated Container Handling System for Refuse Collection Vehicles", filed Jun. 22, 2016.

In alternative applications, which are primarily commercial in nature, a front load refuse truck can be utilized. This version is particularly useful when larger scale refuse containers are utilized. Here, automated collection equipment is positioned at the front of the vehicle. Again, an operator will simply drive the vehicle to an appropriate location adjacent the refuse container, thus allowing the automated equipment to carry out the remainder of the process.

In operation, the operator will continue collecting refuse from numerous containers, until the point where the truck is at capacity or full. At this point in time, the truck is driven to a drop-off site, which is most typically an incinerator or a landfill. Once at the drop-off site, the contents of the truck can be dumped or ejected, thus allowing for further handling of the collected materials. To carry this out, there are two generally accepted mechanisms for the removal of collected materials: (1) a rear eject approach, and (2) a dump approach. As suggested, the dump approach involves lifting a front portion of the refuse body, so all contents will be allowed to fall from within. This approach, similar to a dump truck, requires mechanisms to lift the front portion of the truck body. Alternatively, the rear eject approach simply utilizes internal mechanisms to push the contents from within the vehicle. In each case, a rear door is utilized to enclose the internal chamber or collection hopper.

Several potential hazards or disadvantages exist with the above-referenced dump approach. When delivering materials to a landfill, access roads and dump locations are often unstable, uneven and not level. In these circumstances, raising a portion of the hopper body creates a higher center of gravity, and can create a significant risk of tipping. Further, at incinerator locations there may be height restrictions and other obstructions which discourage the lifting of the hopper body. For these reasons, the full eject approach is more appealing to some operators.

As mentioned above, one embodiment for automated collection equipment involves mechanisms coupled to the curb side of a refuse vehicle. While this certainly provides efficiency during collection operations, it creates challenges when driving. More specifically, the collection equipment must be recessed into appropriate structures within the truck to accommodate operation on streets and roadways. This, however, necessarily requires a recess in the truck body somewhere, which creates additional complications.

When incorporated into a full eject type truck, the complications created by the side load mechanism are further exaggerated. More specifically, this creates a recess in the collection hopper, and an irregular structure to deal with. When attempting to eject the contents, special accommodations must be made for this recess, thereby further complicating the design and adding additional structures/mechanisms.

In addition to the specific details related to garbage handling, several operational and maintenance-related concerns also exist. As will be appreciated, the above-mentioned systems and mechanisms commonly utilize hydraulic actuators and related controls. While these types of systems are fairly well recognized and efficient, service and maintenance is often required. Unfortunately, many of the hydraulic cables, joints and valves are often situated at inconvenient locations within the truck body. Consequently, service and maintenance of these components is extremely difficult, and often requires maintenance personnel to access very undesirable locations. In addition to difficult access, these components are often located adjacent to other hazardous and potentially harmful mechanisms. As one example, the hydraulic valves and related components are often located adjacent vehicle exhaust systems, which are often extremely hot. Consequently, this creates a further dangerous situation.

For each of the above-mentioned reasons, a more effectively and efficiently designed refuse collection body would be beneficial.

SUMMARY

In the various embodiments described below, an improved collection body is provided which efficiently uses all areas of the vehicle, allows for easy service, and specifically considers the safety of the operator. More specifically, the collection body of a refuse collection vehicle has a uniform main hopper with a generally rectangular shape. Most significantly, the inner sidewalls of the main hopper are continuous, thus allowing for easy operation of internal ejection mechanisms without significantly compromising any of the vehicle's capacity. Further, a number of compartments are provided on the vehicle curb-side, at least one of which specifically includes control valves for the multiple systems. Other compartments can be used as storage areas to contain items such as shovels, flags, cones, and tools. Alternatively (or additionally) water tanks or fuel tanks could be place in these compartments. Since these compartments are located curbside, an operator can access the areas/equipment contained therein, while being away from lanes of traffic.

BRIEF DESCRIPTION OF THE DRAWINGS

Further objects and advantages of the refuse collection vehicle can be seen from reading the following detailed description, in conjunction with the drawings, in which.

DESCRIPTION OF THE VARIOUS EMBODIMENTS

To address several of the challenges outlined above, the embodiments disclosed below provide for an improved refuse collection vehicle, capable of efficiently and effectively operating in a well-known manner, while also being easily serviceable and effectively manufactured. Further, accessibility and safety are optimized so that operation is smooth and effective.

Generally speaking, the collection body of the improved collection vehicle is designed to have a side pickup mechanism capable of handling refuse containers in a well-known manner. Examples of such side pickup mechanisms are shown and discussed in U.S. patent application Ser. No. 15/189,150 entitled "Automated Container Handling System for Refuse Collection Vehicles", filed Jun. 22, 2016 and U.S. patent application Ser. No. 15/353,255 entitled "Belt Operated Container Handling System for Side Loader", published as U.S. Patent Application 2018/0134484, both assigned to the assignee of the present application, and both incorporated by reference.

Figure 1:
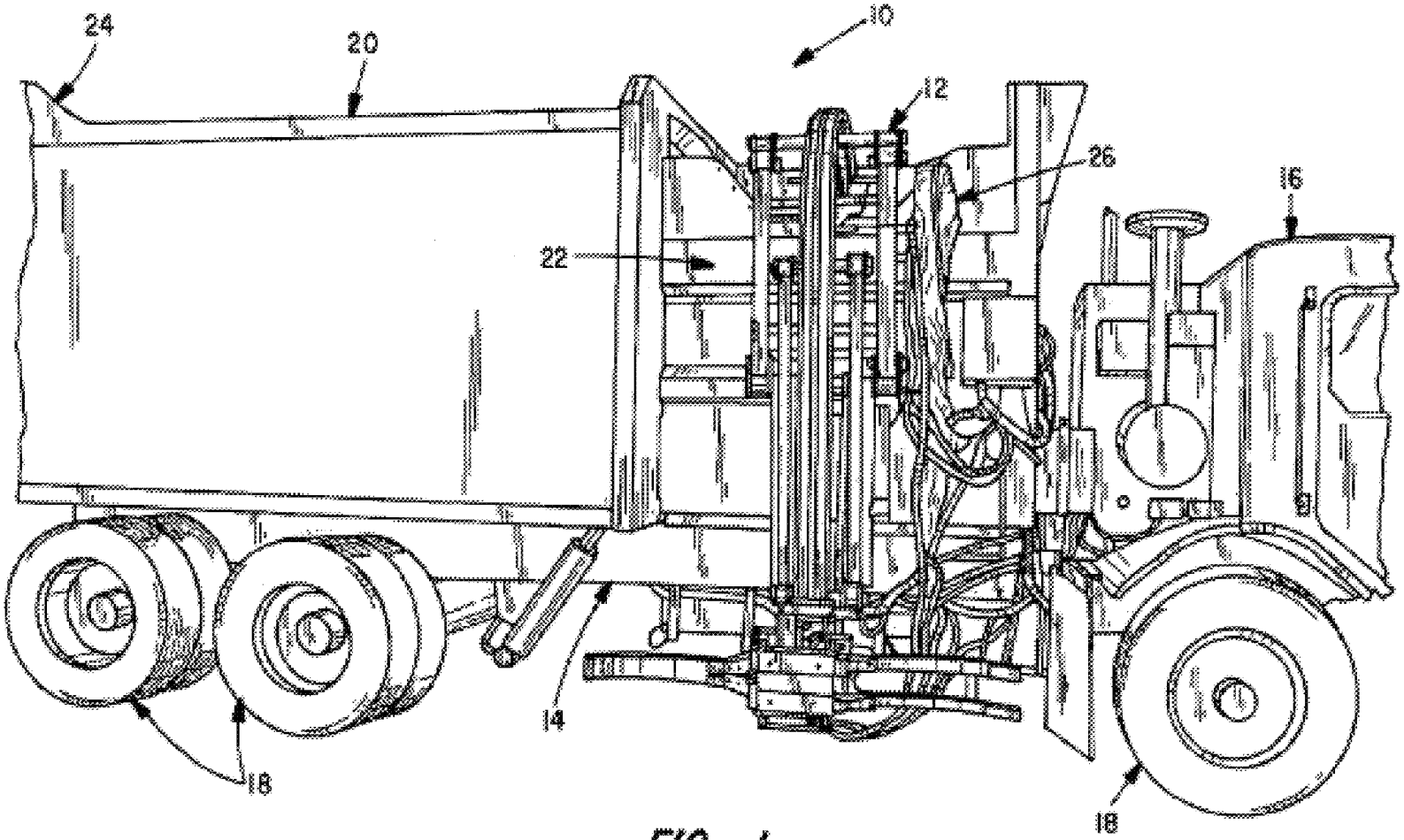
FIG. 1 is a side view of an exemplary refuse truck using the efficient design described herein.

Referring to FIG. 1, one example of a collection mechanism is illustrated. FIG. 1 depicts a side elevational view of a sideloading refuse truck 10, incorporating a truck mounted container handling system 12. The vehicle includes a chassis 14, a cab shown partially at 16 and wheels 18. The vehicle body includes a main hopper or storage chamber 20 which is connected to a collection hopper or charging hopper 22 and a tailgate (not shown) which is pivotally carried by a pair of vertically operating hinges 24 (partially shown at the top rear of the storage chamber 20). The tailgate is operated to open and close by hydraulic cylinders (not shown). Operation of the tailgate and truck body are well known to those skilled in the art. Electrical and hydraulic connections to the container handling system are shown at 26.

As suggested above, the collection body can be emptied by tilting, or through the use of an ejection mechanism. While both systems have their advantages, the body outlined below is well adapted for use in a full rear eject configuration. That said, appropriate hydraulic cylinders can be easily added to create a dump body, while still taking advantage of the several advantages further outlined below.

As will be recognized, the collection hopper 22 is conveniently positioned adjacent the pickup mechanism 12, thus allowing for easy transport of waste material from the collection containers into the truck itself. The main hopper 20 is conveniently positioned behind the collection hopper 22 such that waste material can easily be transferred at appropriate points in time. Clearly, when the collection hopper 22 is full, it will then be necessary to transfer materials to the main hopper 20. This is accomplished by an internal pusher mechanism (not shown) which is typically hydraulically driven. This operation will continue until the main hopper 20 becomes full.

As suggested above, a typical refuse collection body design includes a recess for the side pickup mechanism 12 by having the collection hopper 22 be slightly narrower in width than the main hopper 20. This is done so that main hopper 20 capacity can be maximized while also positioning or stowing the collection mechanism 12 at an appropriate location so as to avoid interference. Again, the differences in width create a challenge for internal handling mechanisms. To address this challenge, the various embodiments discussed below (illustrated schematically in FIG. 2) utilize a main hopper 150 and collection hopper 120 which are the same, or substantially the same width. As will be appreciated, this configuration allows for easy waste handling using a single push mechanism. Despite this difference in design, the same general operation can be followed where the collection hopper 120 is utilized to collect waste, and this waste is then transferred to the main hopper 150 as necessary. This transfer can also include a compaction process, where waste contained within the main hopper 150 is compacted toward the rear of the truck as collection operations continue. This process will continue until the main hopper 150 is full, thus requiring the truck to be driven to an unloading point, such as an incinerator or landfill.

In order to support a body design where main hopper 150 and collection hopper 120 are substantially the same width, while also providing an appropriate recess to receive the collection mechanism, an additional compartment is created within the body. More specifically, this additional compartment is positioned along one side of the main hopper, and rearward of the collection mechanism.

The new compartment mentioned above creates an opportunity for further improvements and enhancements to the body of the refuse collection vehicle. As is well-recognized, the body itself includes several systems and controls to carry out refuse collection operations. Many of the systems include hydraulic components, and require hydraulic tubes/hoses, valves, and related control mechanisms. The inclusion of the compartment itself creates an opportunity to reposition several of these operating components at a location which is easily accessible, and conveniently located within the garbage truck body. By moving these components to this location, service can be easily carried out from the curb side of the vehicle, and any related troubleshooting maintenance/repair can also be completed without requiring mechanics/service personnel to climb under the truck or access difficult locations. In addition, this provides a location for other components such as fire extinguishers, schematics, service manuals, tools, etc. Further, lights could be positioned within this service compartment, thus further enhancing the ability of operators/maintenance personnel to carry out their jobs conveniently and safely.

In addition to the details above, moving several of the operating components to the service compartment also frees up space on the vehicle itself, and creates a substantially self-contained system which can be manufactured separately from a truck chassis itself. Consequently, manufacturing operations can occur at separate times, and optimum efficiency can be achieved. More specifically, a collection body can be substantially fabricated as one unitary component, prior to installation on a truck chassis. This allows for easy customization of trucks since the refuse collection body can be easily mounted to any variety of truck chassis. This also allows a manufacturer to potentially stockpile refuse collection bodies, while waiting for an appropriate truck chassis to arrive, or during those periods where unused manufacturing resources exist. As such, this provides significant flexibility and efficiency for manufacturers.

Figure 2:
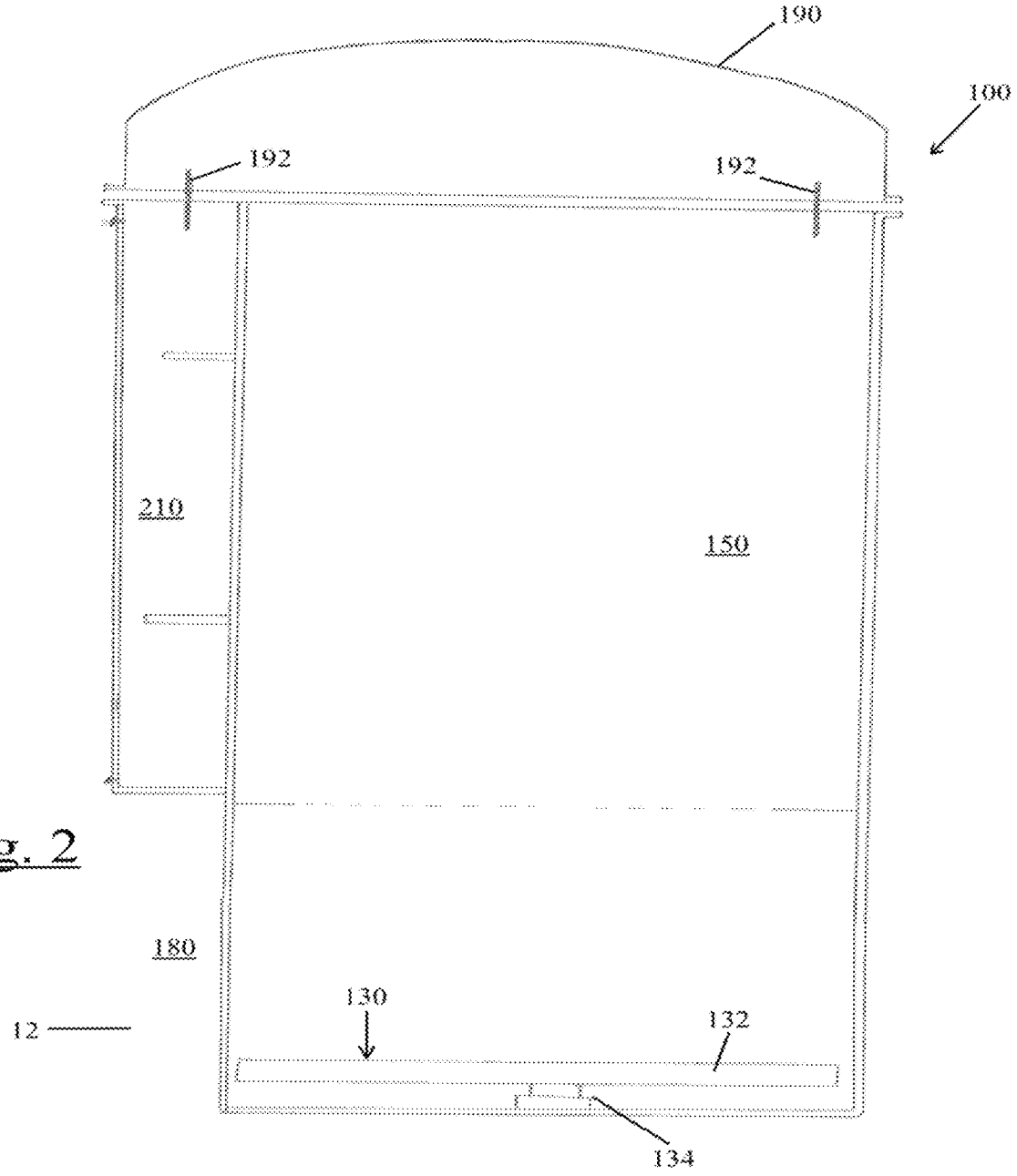
FIG. 2 is a top schematic view of the body design and layout.

Referring now to FIG. 2, a top cross-sectional schematic view of the refuse collection body 100 is generally illustrated. As conceptually shown, refuse collection body 100 is divided into a collection hopper 120 and a main hopper 150. Positioned at the rear of refuse collection body 100 is a tailgate 190 which is attached via a pair of hinges 192 and which is configured to be opened when necessary. Tailgate 190 is configured very similar to a dump truck tailgate, where it is allowed to hinge from above.

In operation, container handling mechanisms 12 are positioned adjacent the collection hopper 120 and are configured to dump materials into this portion of body 100. As refuse is collected, collection hopper 120 will become full, thus creating the need for additional operations. At this point, a pusher mechanism 130 will be utilized. Pusher mechanism 130 includes a push plate 132 and a hydraulic cylinder 134. Operating hydraulic cylinder 134 will cause push plate 132 to be moved rearward, thus resulting in the movement of any refuse contained within collection hopper 120. This refuse is then transferred to main hopper 150 in a well-known manner. Over time, main hopper 150 will become full. Push plate 132 can also be used for compacting refuse contained within main body 150. As will be recognized, when main hopper 150 is full, the refuse vehicle will be moved to a dispensing location. At this time, tailgate 190 can be raised and push plate 132 advanced, thus causing any refuse contained body 100 to be ejected through the rear opening created when tailgate 190 is raised. As illustrated in FIG. 2, collection hopper 120 and main hopper 150 have a substantially constant width, which will accommodate the efficient operation of push mechanism 130.

As mentioned above, collection mechanism 12 must have a recessed or stowed location on body 100 so this component does not extend from the side of the vehicle when being driven on various roadways. This is accommodated by a recess 180 positioned adjacent collection hopper 120. This recess creates available space behind or rearward, which is thus utilized for alternative components. In this embodiment, the space behind recess 180 is used to support a compartment 210 which is utilized to house many different and/or systems components. As generally discussed above, these components may include control systems, valves, electronics, oil reservoirs, etc. Further, compartment 210 in this embodiment can be utilized to contain safety equipment (i.e., fire extinguishers), tools and any other operating accessories necessary for operation of the vehicle. In this embodiment, compartment 210 is illustrated as a single compartment having a couple strengthening ribs. Clearly, variations on this are possible, depending on the needs and specific concerns of the vehicle owner/operator. This could include multiple compartments, with each being separately accessible.

As mentioned above, one significant component contained within chamber 210 are the various hydraulic components required for operation. As is well recognized, a refuse body 100 of this type requires several hydraulic systems, and related valves. For example, there could be multiple valves required for the container handling apparatus, tailgate, packer cylinder, a pre-crush panel, or any other movable mechanisms. By moving all related valves and hydraulic component, these elements are conveniently situated on the curbside of the vehicle, at work height, and easily accessible. Thus, servicing or repair of these elements is easily accomplished in a safe and effective manner. In addition, it is often necessary to have a relatively sizable oil reservoir to support the various hydraulic systems. Allowing space within compartment 210 for this reservoir provides efficient and convenient placement, and avoids the need to find space on the truck chassis (which often required relocation of other components such as gas tanks or battery boxes). Further, appropriate lighting, schematic diagrams, manuals, etc., could also be situated within compartment 210, thus providing all resources necessary for maintenance/repairs.

Figure 3:
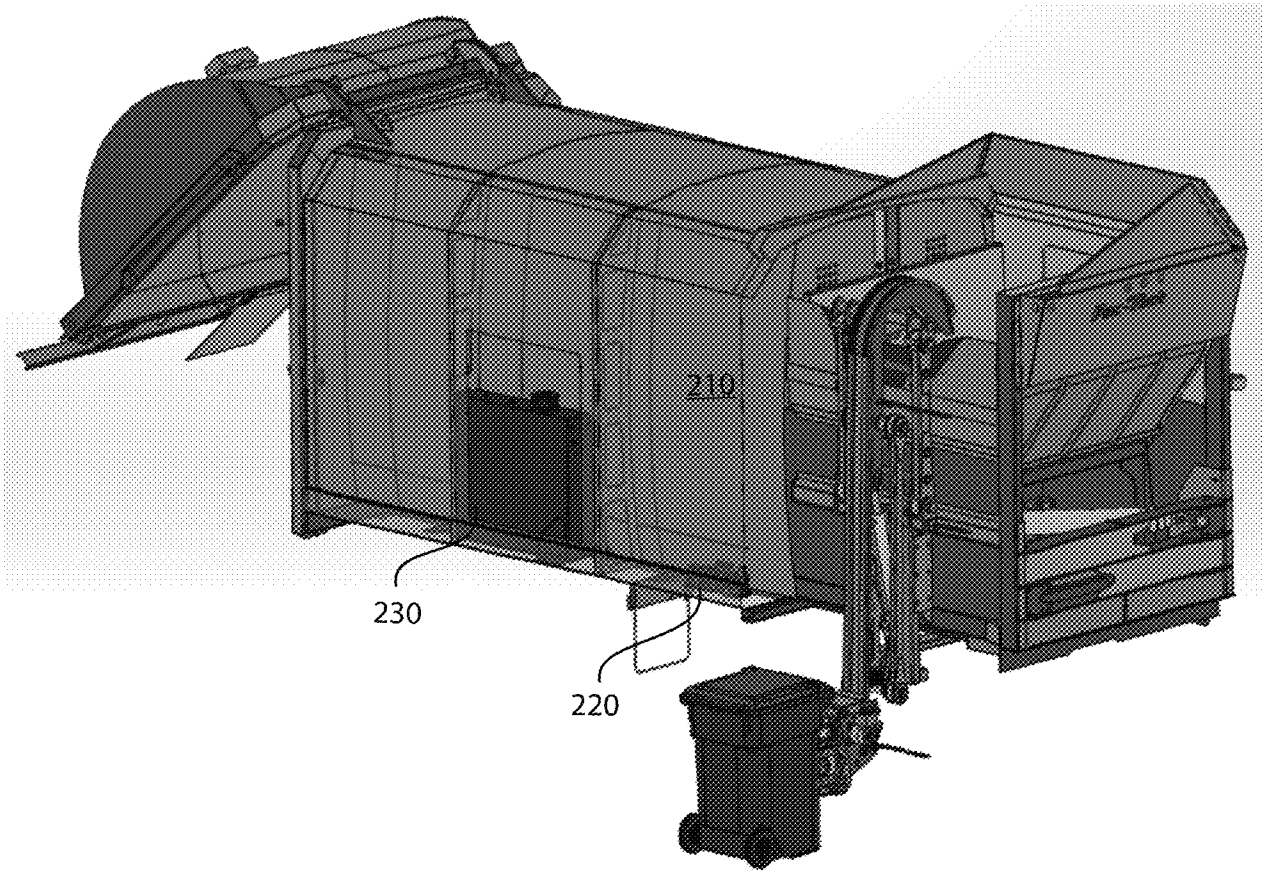
FIG. 3 presents a side perspective view of the collection body and improved layout.
Figure 4:
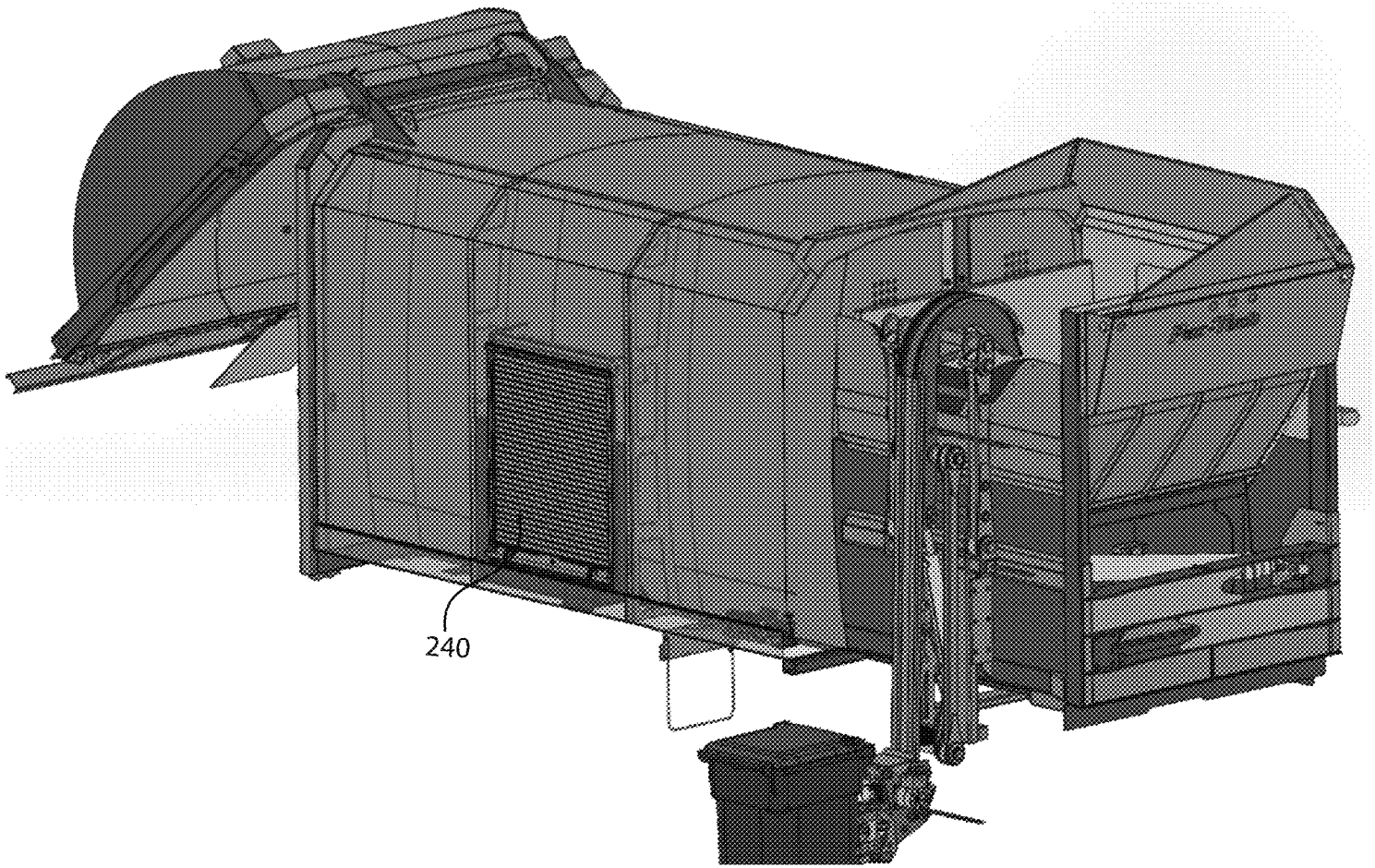
FIG. 4 presents a side perspective view similar to FIG. 3, with a sliding door in place.

Referring to FIGS. 3 & 4, one version of the compartment configuration is illustrated. As shown in FIG. 3, the control valves 220 are positioned in a front portion of compartment 210, while an oil reservoir 230 is place in a more rearward portion of compartment 210. As shown, valves 220 are easily accessible and conveniently located for maintenance and repair. Further, valves 220 are located on the curb side of the vehicle so they could potentially be accessed while on the road, with the operator being away from traffic. Further, compartment 210 provides an appropriate and effective location for oil reservoir 230.

Figure 5:
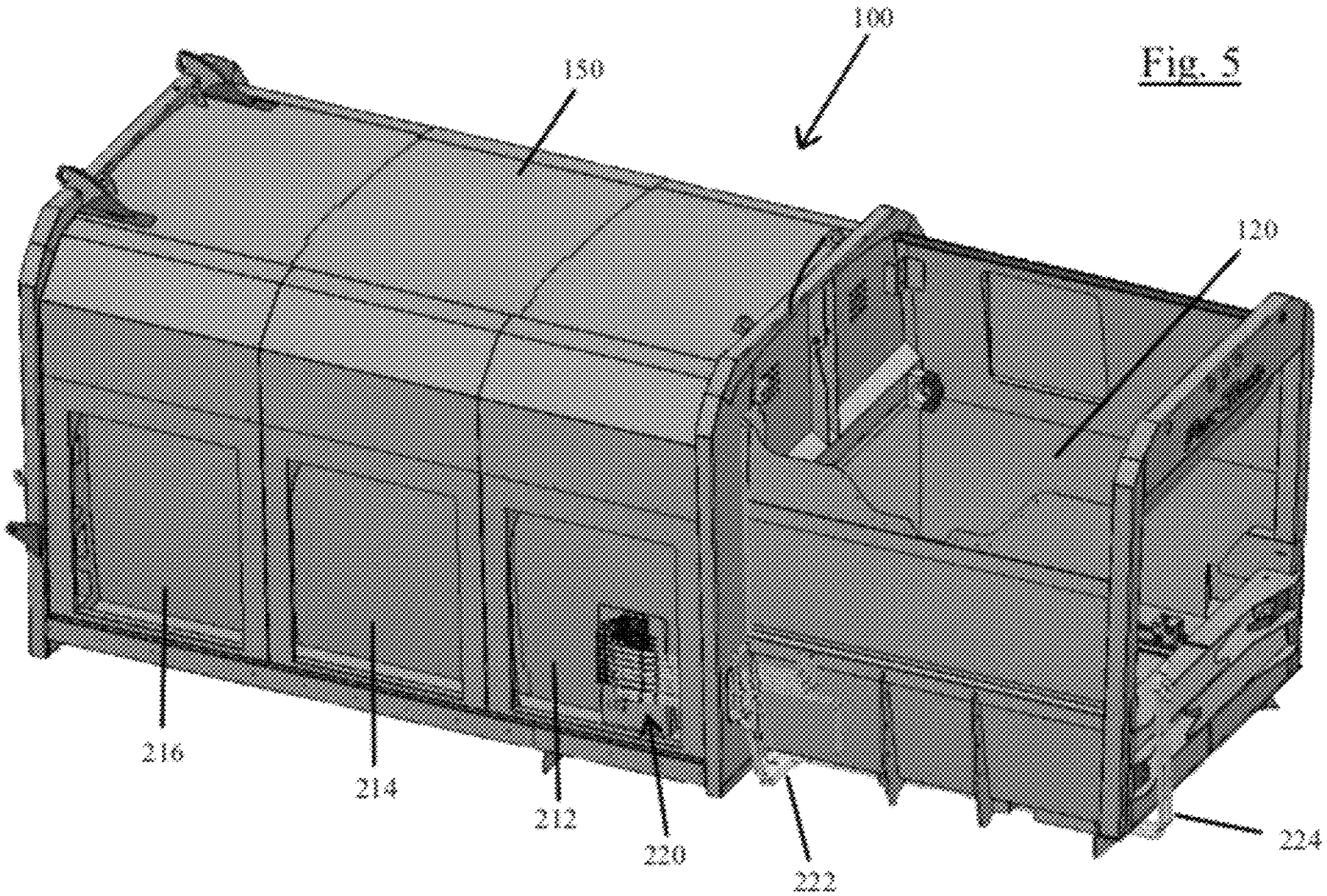
FIG. 5 illustrates an alternative partial perspective view of the collection body showing multiple compartments.
Figure 6:
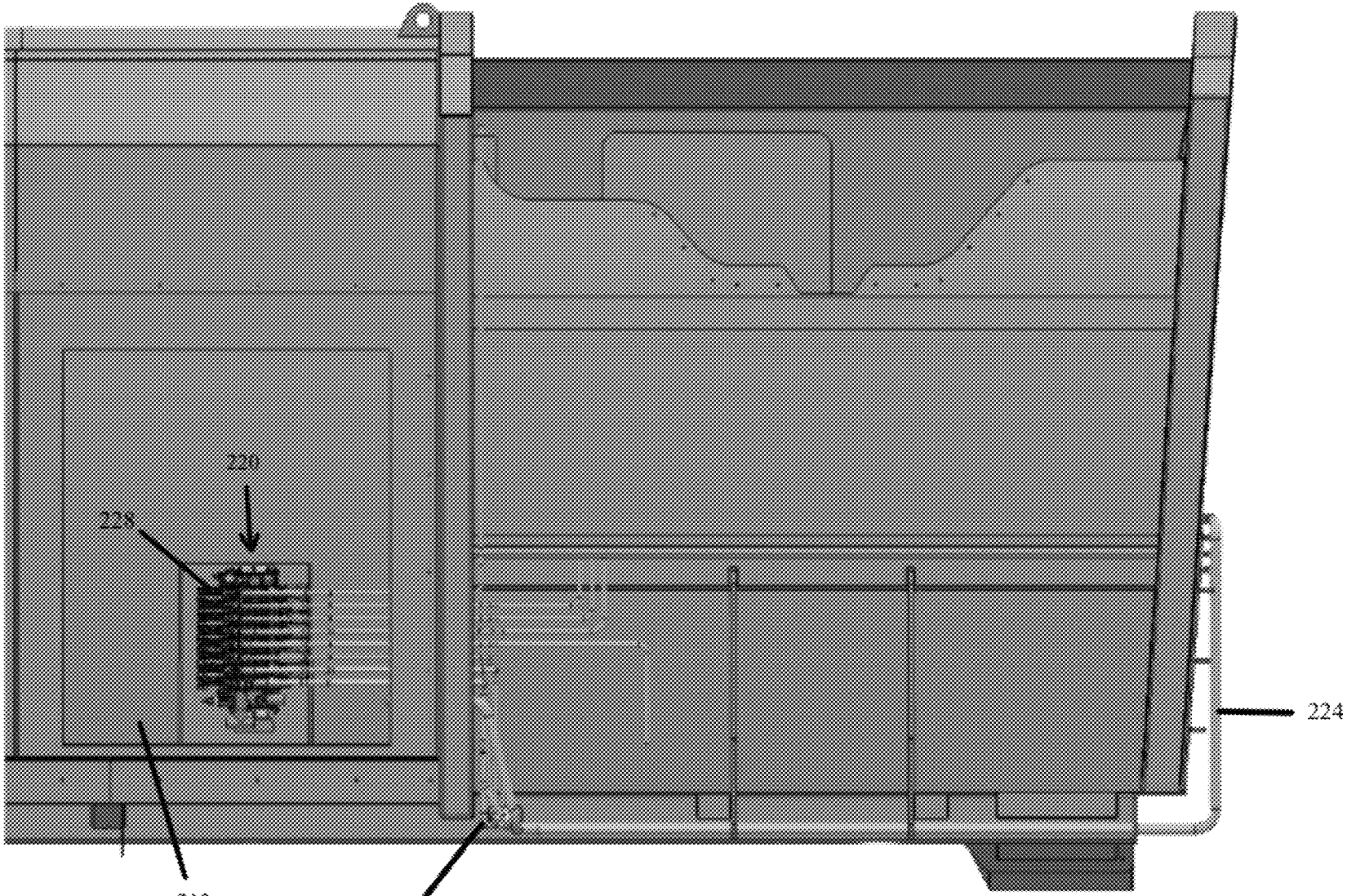
FIG. 6 shows a side view of a portion of the collection body better illustrating the placement of multiple valves.
Figure 7:
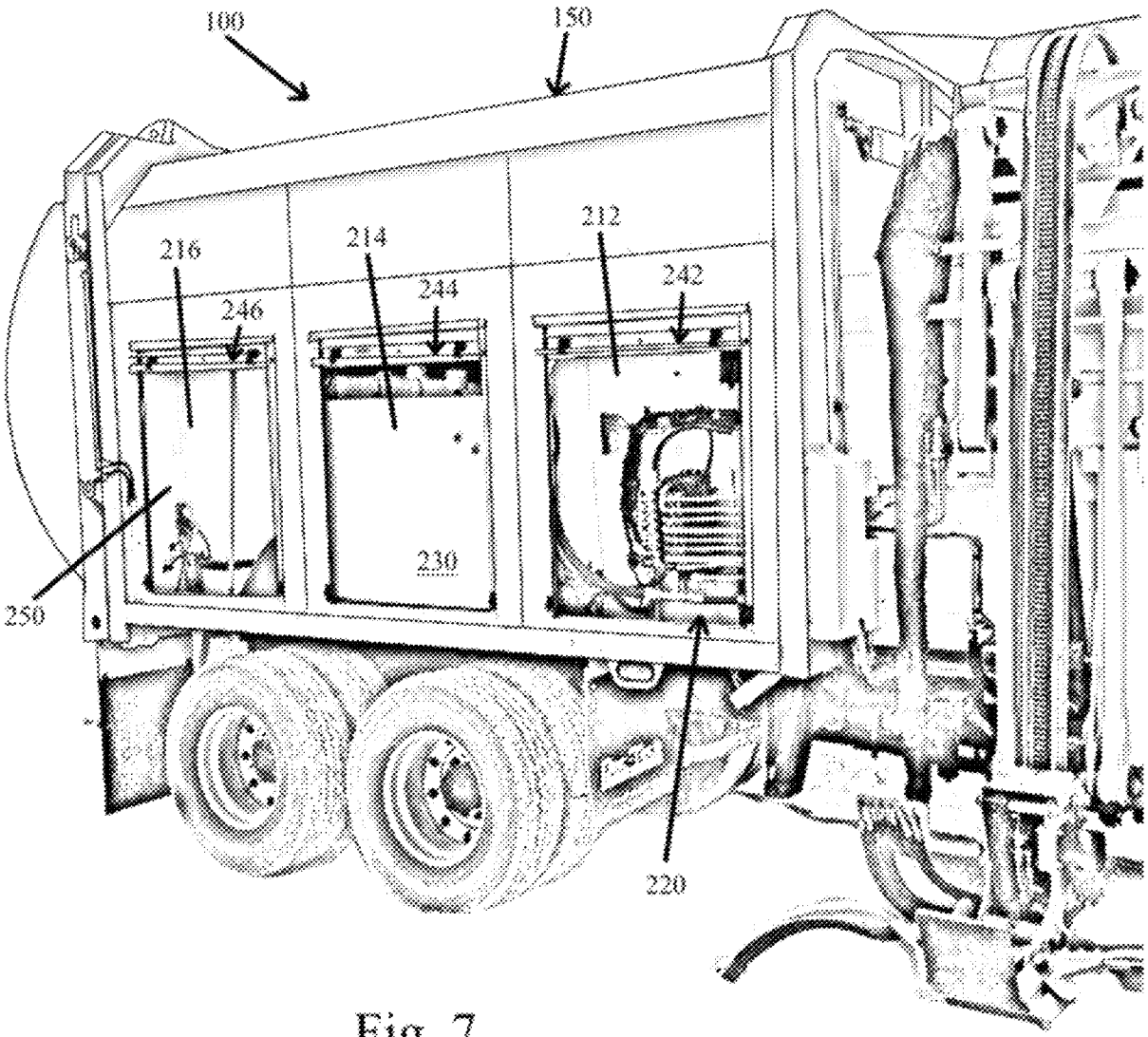
FIG. 7 presents a perspective view of three exemplary compartments at the side of the refuse collection body.

As suggested above, access to control valves 220 is a significant feature which allows for easy trouble shooting, maintenance and repairs of hydraulic systems. As illustrated in FIG. 5, control valves 220 are positioned within first compartment 212. It will be appreciated that this placement allows for easy access thereof from the curb side from of refuse vehicle 10. In certain instances, hydraulic lines 222 and 224 are shown to illustrate how routing throughout refuse body 100 is achieved. These features are better illustrated in FIG. 6, which includes a close up view of compartment 212 and control valves 220. As shown, the various hydraulic lines are routed to a control valve block 228. Those skilled in the art will recognize that this is one alternative for the placement of control valves 220 and various other approaches could be utilized. FIG. 7 also illustrates this layout, with control valves 220 being located in first compartment 212.

To provide safe access to compartment 210, it is contemplated that the body 100 will have at least one access door 240. In the embodiment illustrated in FIG. 4, a roll-up door is used, so that access can be provided, while also avoiding the possibility that a door could swing open during operation of the refuse vehicle. This type of door provides sufficient protection for the contents of compartment 210, while also efficiently using existing space within body 100. While only one door 240 is shown in FIG. 4, it is contemplated that several doors could exist, again depending on the needs and concerns of the vehicle owners/operators. As an example, FIG. 7 shows three compartments 212, 214, 216 each with relate roll-up doors 242, 244, 246.

It should be apparent that the overall design of body 100 provides the ability to effectively carry out refuse collection operations, while also providing a body that is sufficiently sized to cover all wheels, and efficiently utilize space. Generally speaking, it is contemplated that the refuse body 100 will have a capacity of approximately 28 cubic yards, however, this could be easily varied depending on the particular design and/or needs of the user.

In addition to the features mentioned above, it should also be apparent that, by moving all valves and related control components within compartment 210, substantially all plumbing and wiring for body 100 can be achieved substantially without the truck chassis itself. As such, collection body 100 becomes a substantially self-contained unit, thus providing significant manufacturing advantages.

Although body 100 illustrated in FIG. 2 is illustrated as having a collection hopper and main hopper with an identical width, it is contemplated that some variation is possible without departing from the spirit of the invention. Additionally, the discussion above outlines several hydraulic systems used to carry out many of the necessary operations. While hydraulic systems are effective and proven, it is clearly contemplated that other types of systems could be used.

In one embodiment illustrating many of the features discussed above, FIG. 7 provides a partial perspective view of collection body 100. Shown in this embodiment are three side compartments, a first compartment 212 a second compartment 214 and a third compartment 216. Again, these compartments are generally discussed above, and are well recognized as including certain utility. Also specifically shown in FIG. 7 are related roll-up doors 242, 244 and 246. As will be appreciated each of these roll-up doors are located in an upper portion of the related compartment (i.e. first compartment 212, second compartment 214 and third compartment 216). In this embodiment, control valves 220 are located within first compartment 212. Second compartment 214 contains an oil reservoir 230, while third compartment 216 is configured to house various tools 250. Each of these areas are available due to the specific configuration of the collection hopper 120 and main hopper 150, as generally discussed above.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A refuse collection body mountable to a truck chassis, comprising:

a collection hopper positioned at a front end of the collection body;

a main hopper positioned behind the collection hopper, the main hopper and the collection hopper sharing an intermediate wall having an opening therein configured to allow waste to be transferred from the collection hopper to the main hopper, the main hopper having substantially continuous sidewalls and being substantially rectangular in shape with a width that is substantially equal to a width of the collection hopper;

a waste transfer mechanism configured to move waste from the collection hopper to the main hopper;

an ejection system contained within the main hopper and configured to eject waste from the main hopper out of an opening in a rear end of the main hopper;

a side loader positioned on a curb-side of the collection body and configured to retrieve a waste containers and deposit any contents of the waste container to the collection hopper; and a utility compartment positioned adjacent the main hopper on a curb side of the body and behind the side loader, the utility compartment configured to contain a plurality of hydraulic valves used for operation of the side loader and the waste transfer mechanism, wherein the utility compartment and the main hopper define an outer width for the refuse collection body, and wherein the collection hopper has a width less than the outer width of the refuse collection vehicle thereby allowing the side loader to be at least partially recessed within the defined outer width when in a retracted position.

2. The refuse collection body of claim 1, wherein the utility compartment further includes an electronic control system configured for operating all systems of the refuse collection body.

3. The refuse collection body of claim 2 wherein the opening between the collection hopper and the main hopper spans substantially the width of the shared wall.

4. The refuse collection body of claim 3 wherein the ejection system includes a pusher configured to span substantially the entire width of the main hopper.

5. The refuse collection body of claim 2 wherein each hydraulic valve can be serviced from the curb side of the body, when mounted to the truck chassis.

6. The refuse collection body of claim 1 wherein the utility compartment extends from a position immediately behind the side loader to the rear end of the main hopper.

7. The refuse collection body of claim 6 wherein the utility compartment comprises a plurality of cabinets, and each cabinet is enclosed by a roll-up door.

8. The refuse collection body of claim 7 wherein at least one of the cabinets contain an oil reservoir.

9. The refuse collection body of claim 7 wherein at least one of the cabinets contain an area for storage of tools.

10. A refuse collection body mountable on a truck chassis, comprising:

a storage chamber mounted on a rear portion of the truck chassis configured to store collected refuse therein, the storage chamber having a rear opening configured to accommodate ejection of refuse and a collection opening positioned in a front wall thereof;

a utility compartment positioned on a curb side of the storage chamber, wherein the storage chamber and the utility compartment define a width of the refuse collection body;

a tailgate hingably connected to a rear portion of the storage chamber and configured to selectively cover the rear opening;

a collection hopper mounted on the truck chassis at a position in front of the storage chamber and adjacent to the collection opening, the collection hopper having a width which is less than the width of the refuse collection body;

a waste transfer system selectively operable to cause refuse to be transferred from the collection hopper to the storage chamber via the collection opening, wherein the waste transfer system further comprises a pusher mechanism movable from a stowed position toward a front portion of the collection hopper to an extended position toward a rear portion of the storage chamber; and a side loader positioned on a curb-side of the refuse collection body, adjacent to the collection hopper and in front of the utility compartment, the side loader configured to retrieve a waste container and deposit contents of the waste container to the collection hopper;

wherein the collection hopper and the storage chamber have substantially the same width and wherein the collection opening spans substantially the entire width of the storage chamber.

11. The refuse collection body of claim 10 wherein the utility compartment is configured to contain a plurality of hydraulic valves.

12. The refuse collection body of claim 10 wherein the utility compartment contains an electronic control system configured to control operation of a plurality of systems on the refuse collection body.

13. The refuse collection body of claim 10 where the utility compartment extends from a position immediately behind the side loader to a rear end of the collection body, and wherein the utility compartment comprises a plurality of cabinets, and wherein each cabinet is enclosed by a door.

14. The refuse collection body of claim 13 wherein the plurality of cabinets are configured to contain at least one item selected from the group of hydraulic valves, an electronic control system configured to control operation of a plurality of systems on the refuse collection body, tools, safety flags, spare parts and an oil reservoir.

15. The refuse collection body of claim 13 wherein the side loader is movable between a stowed position and an extended position, wherein when in the stowed position the side loader is at least partially recessed within the defined width of the refuse collection body.

16. The refuse collection body of claim 10 wherein the storage compartment has a floor for supporting refuse and the collection hopper has a floor adjacent the collection opening, and wherein the storage compartment floor and the collection hopper floor are substantially aligned with one another.

* * * * *